United States Patent [19]

Link

[11] 4,324,496

[45] Apr. 13, 1982

[54] TYPE DISC PRINTER

[75] Inventor: Manfred Link, Nuremberg, Fed. Rep. of Germany

[73] Assignee: Triumph-Adler A.G., Nuremberg, Fed. Rep. of Germany

[21] Appl. No.: 215,648

[22] Filed: Dec. 12, 1980

[30] Foreign Application Priority Data

Apr. 15, 1980 [DE] Fed. Rep. of Germany ..... 3014286

[51] Int. Cl.[3] ..... B41J 1/46

[52] U.S. Cl. ..... 400/144.2; 400/175

[58] Field of Search ..... 400/144.2, 144.3, 144.4, 400/175, 144, 144.1

[56] References Cited

U.S. PATENT DOCUMENTS

| | | | |
|---|---|---|---|
| 3,371,766 | 3/1968 | Staller | 400/144.3 |
| 4,049,109 | 9/1977 | Plaza et al. | 400/175 X |
| 4,197,022 | 4/1980 | Dollenmayer | 400/144.2 |
| 4,245,917 | 1/1981 | Mosciatti et al. | 400/144.2 |

FOREIGN PATENT DOCUMENTS

| | | | |
|---|---|---|---|
| 132477 | 10/1978 | Fed. Rep. of Germany | 400/175 |

*Primary Examiner*—Edgar S. Burr
*Assistant Examiner*—Charles Pearson

[57] ABSTRACT

To change a type disc without moving or removing a ribbon cartridge while yet permitting the location of a ribbon cartridge closer to the printing point of a type disc printer, there is provided mechanism to allow pivoting movement of a hammer assembly relative to an independently pivoted type disc drive assembly thereby to change their relative orientation, after which continued movement of the hammer assembly carries the pivotally mounted type disc drive assembly to a type disc change position. The change in orientation of the hammer assembly relative to the type disc drive assembly, before pivoting the type disc assembly, allows greater arcuate movement to type disc change position without interference between the hammer assembly and the ribbon cartridge.

7 Claims, 6 Drawing Figures

TYPE DISC PRINTER

This invention relates to type disc printers having structure supporting type disc drive, hammer magnet, and ribbon assemblies; more particularly it relates to type disc printers wherein the hammer magnet assembly and type disc drive assembly are independently pivoted for movement to type disc change positions; and specifically to a type disc printer having mechanism for connecting the hammer magnet assembly to move the type disc drive assembly following reorientation movement of the hammer magnet assembly.

In known type disc printers, a carriage supports a type disc drive assembly, a hammer magnet assembly, and ribbon cartridge assemblies. To change or mount a type disc in such printers requires that the type disc assembly be pivoted from a printing position to a type disc change position whereat the central hub of the type disc is exposed for removal of the type disc from its drive or positioning shaft. In the prior art the type disc drive and hammer magnet assembly are pivoted as a unit relative to a ribbon assembly on which a ribbon cartridge or cassette is mounted, or all three assemblies are pivoted as a unit. In those machines where the ribbon assembly is not pivoted as a unit with the type disc drive and hammer magnet assemblies, either the ribbon cartridge must be first removed to avoid interference with the hammer magnet assembly, or the ribbon assembly must be located overly far from the printing plane to avoid interference by the ribbon cartridge with the movement of the hammer magnet assembly. In those machines where all three assemblies are moved as a unit, sufficient space must be provided to accomodate the arc of movement of the ribbon assembly and cartridge through an angle necessary to provide easy removal of the type disc. Removal of the ribbon cartridge in the one noted alternative before movement of the type disc and hammer magnet assemblies to type disc change position, is time consuming and cumbersome. In the other noted alternative where all the carriage supported assemblies move as a unit, space requirements and geometry result in unfavorable overall designs.

In accordance with the invention the type disc drive and hammer magnet assemblies are supported for pivoting movement relative to a ribbon cartridge assembly which can be closely spaced to the printing plane yet allow sufficient space to accomodate movement of the hammer magnet assembly without the necessity to remove the ribbon cartridge beforehand. This is accomplished by independently pivoting the type disc drive and hammer magnet assemblies so that the orientation of the hammer magnet assembly relative to the type disc drive and the ribbon cartridge assembly can be changed, and following such reorientation the hammer magnet and type disc drive assemblies can be moved as a unit to type disc change position relative to and without interference with the ribbon assembly and cartridge.

An object of the invention is to provide an arrangement of type disc drive and hammer magnet assemblies which can be moved to facilitate type disc changes without removal of or interference with a ribbon cartridge.

Another object of the invention is in the provision of structure to allow type disc changes in which the orientation of a hammer magnet assembly relative to a type disc drive assembly is effected before movement of the type disc drive assembly to type disc change position to allow movement though adequate angles without interference with stationary ribbon cartridge assemblies.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
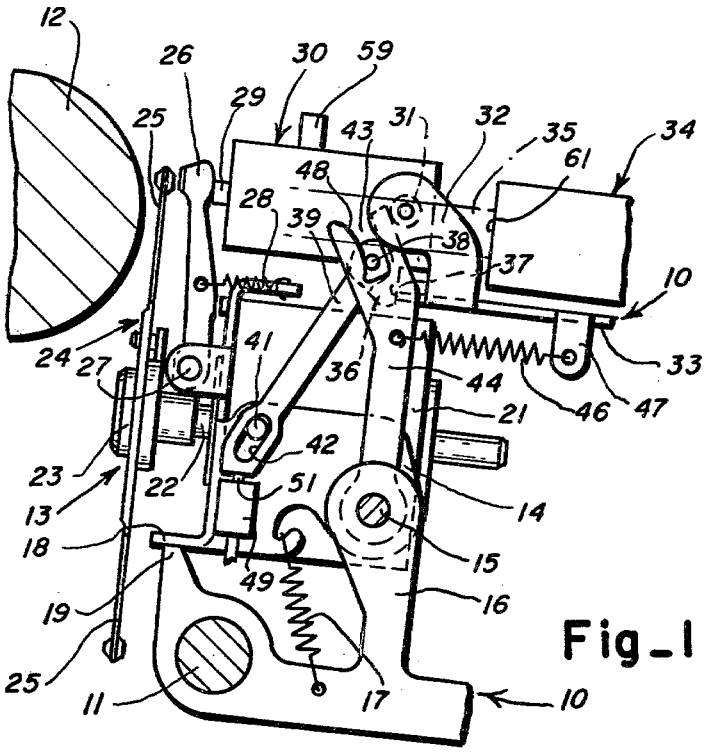
FIG. 1 is a side elevational view of a carriage supported type disc printer.

Referring now to the drawing wherein like reference numerals designate like or corresponding parts throughout the Figures there is shown in FIG. 1 a carriage 10 mounted on a guide bar 11 so as to be moveable along a platen 12 defining a printing plane. The carriage 11 pivotally supports a type disc drive assembly generally designated by reference numeral 13 comprising a motor cradle 14 from which pivot pins 5 extend laterally into spaced upstanding arms 16 of the carriage 10. A spring 17 connected to the cradle 14 at one end and to the carriage 10 at the other end biases the cradle 14 to a print position established by a stop finger 18 on the cradle 14 engaging an abutment 19 on the carriage 10. The cradle 14 supports a type disc drive motor 21 whose shaft 22 supports the hub 23 of a type disc, generally designated by reference numeral 24, to selectively rotatably position the type disc 24 to present selected spokes 25 thereon to a printing position between the platen 12 and a hammer 26 which is pivoted to the motor cradle as at 27. The hammer 26 is driven about its pivot 27 against a return spring 28 to impact a selected spoke 25 against the platen 12 by the armature 29 of a hammer magnet assembly generally designated by reference numeral 30.

Figure 2:
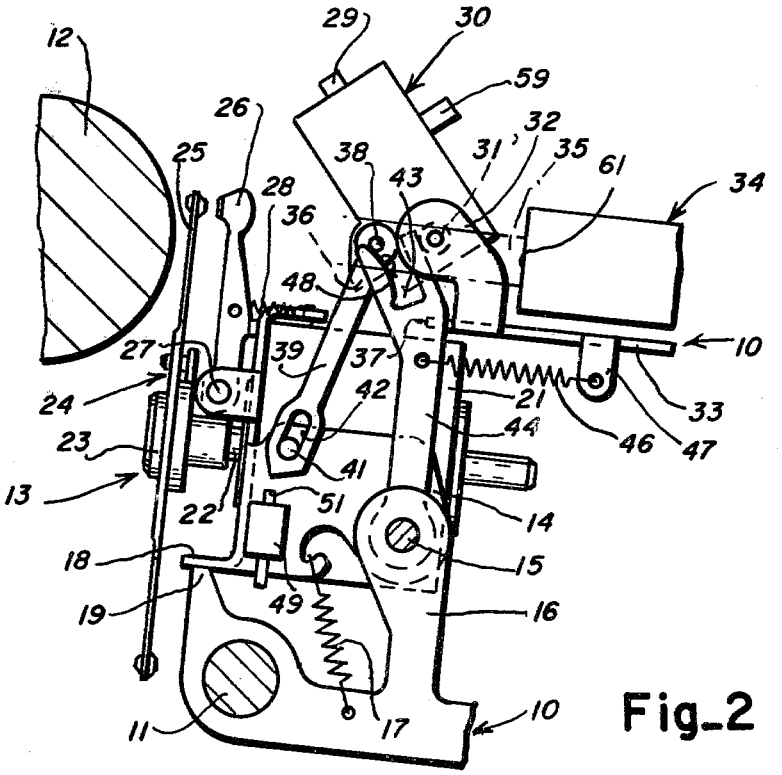
FIG. 2 is a view similar to FIG. 1 showing the hammer magnet assembly moved to an inoperative or reoriented position.

The hammer magnet assembly 30 has oppositely laterally extending pins 31 31' (FIGS. 1 and 4) which are pivotally supported in upstanding spaced arms 32, 32' formed on a platform 33 comprising part of the carriage 10. The carriage platform 33 supports a ribbon assembly including a cartridge 34 from which ribbon 35 is tracked through guides (not shown) between the type spoke 25 at the printing position and the platen 12. As shown in FIG. 1 the print magnet assembly 30 is provided with a depending abutment 36 which engages against a limiting stop edge 37 of the carriage platform 33 in the printing position. Extending laterally from one side of the abutment 36 as shown in FIGS. 1–3 is a pin 38 which rotatably supports the upper end of a link 39 whose lower end is supported on a cradle supported pin 41 which extends into the upper end of a slot 42 in the link 39, forming a lost motion connection to the motor cradle 14.

The end of the pin 38 also extends into the opening 43 formed by the forked upper end of a lever 44 whose other lower end 45 is pivoted to the cradle pin 15. The lever 44 is biased clockwise as shown in FIGS. 1–3 by a spring 46 connected thereto and to a depending ear 47 on the carriage platform 33 to urge the inner curved edge 48 of the opening 43 of the forked end of the lever 44 against the pin 38. In the printing position shown in FIG. 1, in that the pin 38 is below the high point of the curved edge 48, the magnet assembly 30 is thereby detentably held in the printing position against stop 37 by the lever 44.

Figure 3:
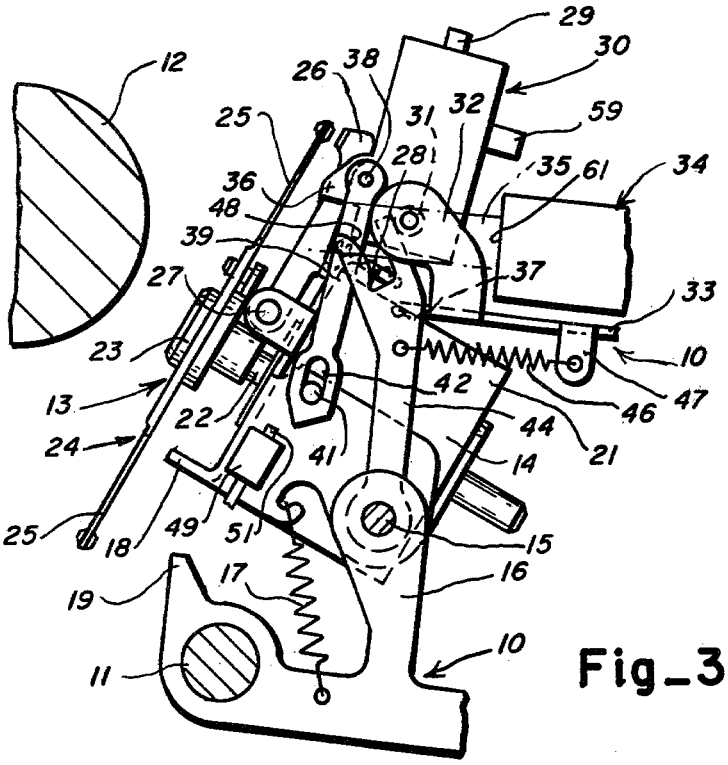
FIG. 3 is a view similar to FIG. 1 showing both the hammer magnet and type disc drive assemblies in type disc change position.

As shown in FIG. 1, a plunger switch 49 may be mounted to the motor cradle 14 for operation to open condition when the lower end of the link moves away from its plunger 51 thereby to open the motor circuit when the type disc drive assembly is moved to type disc change position shown in FIG. 3, to preclude risk of injury to a operator or damage to the type disc 24.

Figure 4:
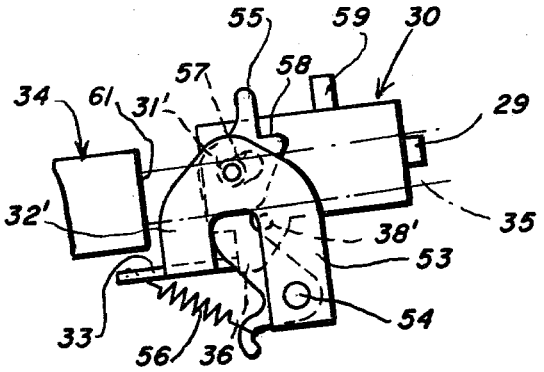
FIGS. 4–6 are elevational views corresponding to FIGS. 1–3 showing the operation of a locking lever associated with the hammer magnet assembly.

Referring now to FIG. 4 which shows the print magnet assembly 30 from the side opposite that shown in FIGS. 1–3, there is shown the arm 32' extending upwardly from the carriage platform 33 which is formed with a leg 53 turning back below the carriage platform 33. The upper end of arm 32' pivotally supports the pin 31' opposite pin 31 while the lower leg 53 pivotally supports as at 54 the lower end of a locking lever 55 which is biased in a clockwise direction as viewed in FIGS. 4–6 by a spring 56 connected thereto and to the carriage platform 33. As shown the locking lever 55 extends upwardly from pivot 54 between the arm 53 and the magnet assembly 30 and is provided with an elongated hole 57 through which pivot pin 31' extends thereby to allow counterclockwise unlatching pivoting movement of the locking lever 55, as will hereinafter appear. Further as shown in FIG. 4 a pin 38' opposite pin 38 on the hammer magnet assembly 30 is provided for cooperation with a latching shoulder 58 on the locking lever 55.

Figure 5:
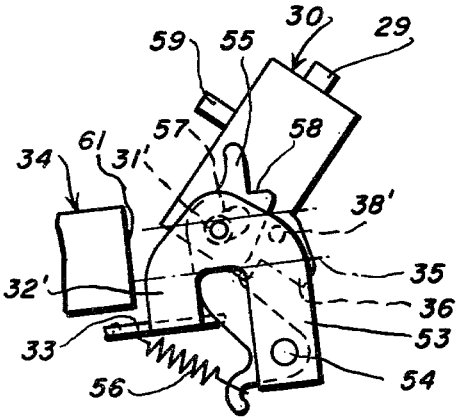

To change a type disc 24 which is removably mounted on the positioning or drive motor shaft 22 it is necessary to pivot the motor shaft 22 upwardly from the FIG. 1 printing position to the FIG. 3 type disc change position to expose the end of the motor shaft 22 to manipulation of and for removal or mounting of the type disc 24. This is accomplished in accordance with the invention by an operator grasping a handle 59 provided on the magnet assembly 30 and pivoting the magnet assembly 29 upwardly about its pivots 31, 31' to an inoperative position shown in FIG. 2 reorientated relative to the motor shaft 22. During the pivoting movement of the magnet assembly 30, the pin 38 thereon rides over the high point of curved edge 48 of the detent lever 44 to a position above the high point of the curved edge 48, with lever 44 moving counterclockwise against its return spring 46 as viewed in FIGS. 1 and 2, to accomodate the pivoting movement to the FIG. 2 position whereat the magnet assembly 30 is detentably held thereby. During movement of the hammer magnet assembly 30 to the FIG. 2 position the motion of link 39 is accomodated by slot 42 without moving the motor cradle 14. FIG. 5 shows the FIG. 2 position from the opposite side.

Figure 6:
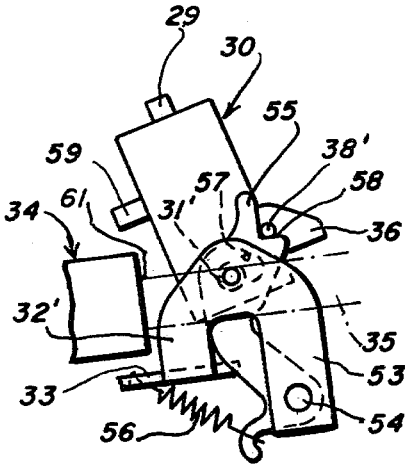

Continued clockwise pivoting movement of the hammer magnet assembly 30 from the FIG. 2 position acts now through link 39, to pull the motor cradle 14 about its pivots 15 against return spring 17 until the FIG. 3 type disc change position is reached. FIG. 6 corresponds to the FIG. 3 position at which pin 38' is captured by shoulder 58 to latch all the parts in the FIG. 3 type disc charge position, permitting the type disc 24 to be removed for replacement by another or for servicing.

Following change of type discs 24, the locking lever 55 is rotated counterclockwise as viewed in FIG. 6 as permitted by hole 57, to release pin 38'. As a result the hammer magnet assembly 30 and type disc drive assembly 13 are returned by cradle return spring 17. The return movement of the type disk assembly 13 is to the FIG. 1 position, being arrested by engagement of stop finger 18 on the motor cradle 14 with carriage abutment 19. The return of the hammer magnet assembly 30 is to the FIG. 2 position, being arrested, cushioned and detentably held by engagement of its pin 38 with the curved edge 48 of the detent lever 44. From the FIG. 2 position an operator need merely push the hammer magnet assembly 30 counterclockwise about its pivots 31, 31' to the FIG. 1 position whereat it is again detentably held in proper print position.

Having reference to FIG. 1, it is evident from the geometry that the edge 61 of ribbon cartridge 34 facing the printing plane can be positioned closer to the printing plane without the necessity for its removal, by first reorienting the position of the magnet assembly 30, than would be the case if the hammer magnet assembly 30 was not first reoriented but moved as a unit together with the type disc drive assembly 13. The invention therefore permits a more compact design having consideration to space requirements and also simplifies the task of mounting and changing type discs 24 without having to move or remove ribbon cartridges 34.

While the invention is uncorporated on a carriage movable along a platen it is equally applicable to incorporation in a fixed frame assembly in a machine having a carriage supported platen 12.

The invention claimed is:

1. Printing mechanism including a support frame, a type disc drive assembly pivotally mounted on said support frame for movement from a printing position to a type disc change position, a hammer magnet assembly pivotally mounted on said support frame for movement from a type disc impacting position to an inoperative position to a type disc change position, and means to enable said hammer magnet assembly to be moved from said impacting position to said inoperative position without movement of said type disc drive assembly, said means further serving to pivot said type disc drive assembly to said type disc change position in response to movement of said hammer magnet assembly from said inoperative position to said type disc change position, said means including a lost motion connection between said hammer magnet assembly and said type disc drive assembly.

2. Printer mechanism as recited in claim 1, said lost motion connection including a connecting rod, a first pin on said hammer magnet assembly, and a second pin on said type disc drive assembly, said connecting rod having one end pivotally mounted on said first pin and having a slot adjacent its other end into which said second pin extends.

3. Printing mechanism as recited in claim 2, including detent means on said support frame and said hammer magnet assembly for holding said hammer magnet assembly in its said type disc impacting and its said inoperative positions.

4. Printing mechanism as recited in claim 3, said detent means including a lever, said lever having one end pivoted on said support frame and having a curved surface at its other end, and a spring connected between the ends of said lever and said support frame urging said curved surface against said second pin.

5. Printing mechanism as recited in claim 1, including means for releaseably latching said hammer magnet assembly when said type disc drive assembly is moved by said hammer magnet assembly to type disc change position.

6. Printing mechanism as recited in claim 5, said means for releaseably latching said hammer magnet assembly comprising, a rod on said hammer magnet assembly, and a lever pivotally mounted on said support frame and biased toward said rod, said lever having an abutment to engage said rod when said hammer magnet assembly is moved to its said type disc change position.

7. Printing mechanism as recited in claim 6, including a spring connected between the type disc drive assembly and said support frame for returning said type disc drive assembly to its printing position and said hammer magnet assembly to its inoperative upon release of said latching lever, said detent means cushioning the return of said hammer magnet assembly to its inoperative position, and means on said hammer magnet assembly for returning it to its type impacting position.

* * * * *

UNITED STATES PATENT AND TRADEMARK OFFICE

CERTIFICATE OF CORRECTION

PATENT NO. : 4,324,496

DATED : April 13, 1982

INVENTOR(S) : Manfred Link

It is certified that error appears in the above—identified patent and that said Letters Patent is hereby corrected as shown below:

The Title Page should appear as shown on the attached sheet.

Signed and Sealed this

*Twenty-second* Day of *June 1982*

[SEAL]

*Attest:*

GERALD J. MOSSINGHOFF

*Attesting Officer*

*Commissioner of Patents and Trademarks*

United States Patent [19]

Link

[11] 4,324,496

[45] Apr. 13, 1982

[54] TYPE DISC PRINTER

[75] Inventor: Manfred Link, Nuremberg, Fed. Rep. of Germany

[73] Assignee: Triumph-Adler A.G., Nuremberg, Fed. Rep. of Germany

[21] Appl. No.: 215,648

[22] Filed: Dec. 12, 1980

[30] Foreign Application Priority Data

Apr. 15, 1980 [DE] Fed. Rep. of Germany ..... 3014286

[51] Int. Cl.[3] ..... B41J 1/46

[52] U.S. Cl. ..... 400/144.2; 400/175

[58] Field of Search ..... 400/144.2, 144.3, 144.4, 400/175, 144, 144.1

[56] References Cited

U.S. PATENT DOCUMENTS

| | | | |
|---|---|---|---|
| 3,371,766 | 3/1968 | Staller | 400/144.3 |
| 4,049,109 | 9/1977 | Plaza et al. | 400/175 X |
| 4,197,022 | 4/1980 | Dollenmayer | 400/144.2 |
| 4,245,917 | 1/1981 | Mosciatti et al. | 400/144.2 |

FOREIGN PATENT DOCUMENTS

| | | | |
|---|---|---|---|
| 132477 | 10/1978 | Fed. Rep. of Germany | 400/175 |

*Primary Examiner*—Edgar S. Burr
*Assistant Examiner*—Charles Pearson

[57] ABSTRACT

To change a type disc without moving or removing a ribbon cartridge while yet permitting the location of a ribbon cartridge closer to the printing point of a type disc printer, there is provided mechanism to allow pivoting movement of a hammer assembly relative to an independently pivoted type disc drive assembly thereby to change their relative orientation, after which continued movement of the hammer assembly carries the pivotally mounted type disc drive assembly to a type disc change position. The change in orientation of the hammer assembly relative to the type disc drive assembly, before pivoting the type disc assembly, allows greater arcuate movement to type disc change position without interference between the hammer assembly and the ribbon cartridge.

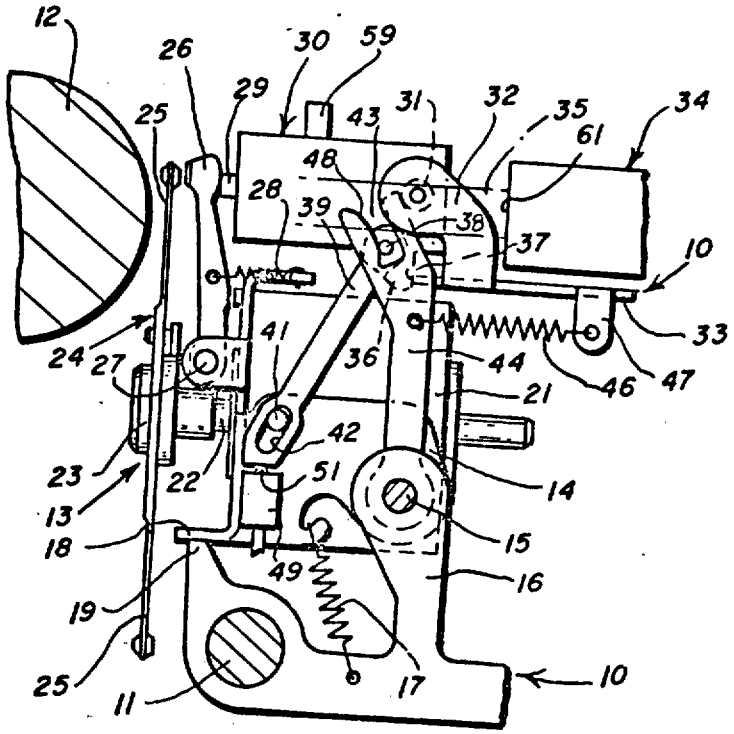

7 Claims, 6 Drawing Figures